United States Patent [19]

Goodall

[11] 4,221,308

[45] Sep. 9, 1980

[54] POURING SPOUT

[76] Inventor: Donald T. Goodall, 30 Beach St., Blakehurst, Sydney, Australia, 2221

[21] Appl. No.: 847,421

[22] Filed: Nov. 1, 1977

[30] Foreign Application Priority Data

Nov. 1, 1976 [AU] Australia ..... PC 7943

[51] Int. Cl.[3] ..... F67D 3/00

[52] U.S. Cl. ..... 222/470; 222/514; 222/525

[58] Field of Search ..... 222/514, 525, 109, 478

[56] References Cited

U.S. PATENT DOCUMENTS

| | | | |
|---|---|---|---|
| 272,980 | 2/1883 | Roberts | 222/109 |
| 432,676 | 7/1890 | Melton et al. | 222/514 |
| 1,694,304 | 12/1928 | Armstrong | 222/109 |
| 2,147,289 | 2/1939 | Furedy | 222/514 |
| 3,934,760 | 1/1976 | Legresley | 222/525 X |

FOREIGN PATENT DOCUMENTS

| | | | |
|---|---|---|---|
| 631894 | 6/1936 | Fed. Rep. of Germany | 222/514 |
| 956296 | 1/1957 | Fed. Rep. of Germany | 222/514 |
| 798158 | 7/1958 | United Kingdom | 222/525 |

*Primary Examiner*—Robert J. Spar
*Assistant Examiner*—Frederick R. Handren
*Attorney, Agent, or Firm*—Emory L. Groff, Jr.

[57] ABSTRACT

The invention relates to an improved pouring spout for pouring liquid from an enclosed container and adapted to be sealingly located within a discharge opening in the container, the spout being moveable to a fully retracted position within the container when a closure is sealingly engaged with the discharge opening, the spout being further moveable to a fully extended position outside the container when the closure is removed from the discharge opening prior to a pouring operation.

5 Claims, 4 Drawing Figures

POURING SPOUT

This invention relates to pouring spouts for use with liquid containers having narrow pouring apertures; for example, petrol drums, oil cans etc.

Hitherto, pouring from containers of this type has generally proved awkward and messy, particularly when the container is in a full or almost full condition. Various types of spouts, funnels etc. have been developed for use with this type of container so as to facilitate pouring. However, such appliances require external attachment to the container after the container has been opened and usually require cleaning before and after use.

Such disadvantages are overcome by the present invention which provides a pouring spout as an integral part of a container structure, the spout being storable within the container so that the need for cleaning of the spout before and after pouring operations is eliminated. Furthermore, the present invention provides a pouring spout which may be detachably connected into a container so that it may be transferred therefrom to a second container when the first container has been emptied.

Accordingly, the present invention provides a pouring spout for pouring liquid from an enclosed container having a discharge opening therein, said spout comprising: a body section sealingly locatable within said discharge opening and having an aperture therethrough for providing an opening into the container when said body section is sealingly located within said discharge opening; a pouring tube passing through said aperture in said body section so that, when said body section is sealingly located within said discharge opening, said pouring tube is moveable through said aperture in said body section from a fully retracted position wherein said pouring tube is located mainly within the container to a fully extended position wherein said pouring tube is located mainly outside the container, the arrangement being such that a liquid tight seal is maintained around said aperture in said body section for all positions of movement of said pouring tube between said fully retracted position and said fully extended position; vent means passing through said body section so as to allow air to pass from the outside to the inside of the container when said body section is sealingly located within said discharge opening; closure means for forming a liquid tight seal across said discharge opening when said pouring tube is in said fully retracted position and the container is not required for a pouring operation so that, in operation, said closure means is removed from said discharge opening and said pouring tube is moved from said fully retracted position to said fully extended position whereupon the container may be tilted to allow liquid to pass therefrom through said pouring tube under the pressure of air entering the container through said vent means.

A preferred embodiment of the present invention will now be described in detail with reference to the accompanying drawings in which.

Figure 1:
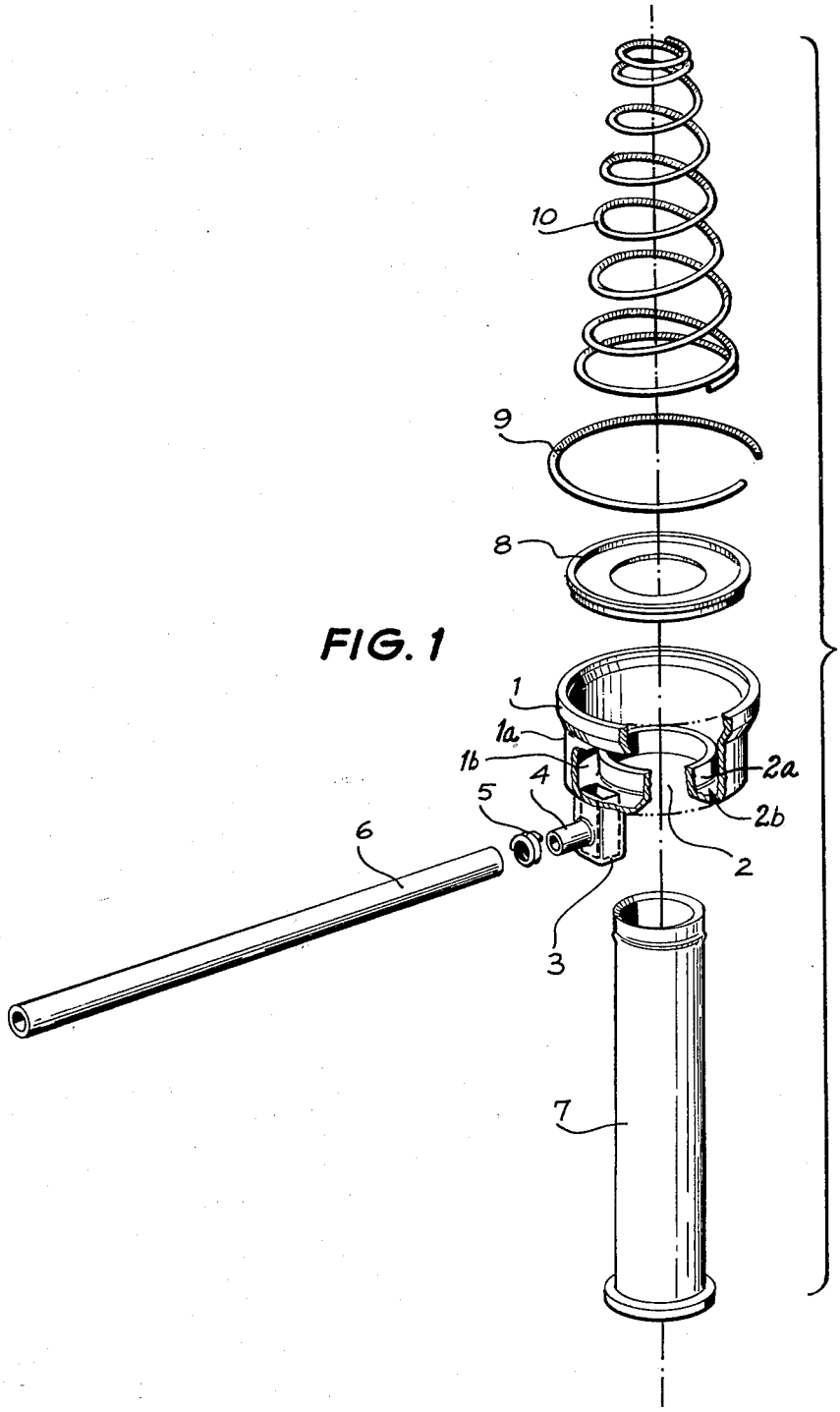
FIG. 1 is an exploded view showing all the parts of a pouring spout according to the present invention.

Referring to FIG. 1 of the drawings, a pouring spout according to the present invention comprises a body section 1 including a sidewall 1*a* and a bottom wall 1*b* having an aperture 2 therein. Surrounding the aperture 2 is an upstanding annular flange 2*a* spaced from the sidewall 1*a* of the body 1 so as to form a circular trough 2*b* for receiving any liquid trapped in the vent tube 6 which liquid would normally spill when the container is tilted for a pouring operation. A pouring tube 7 passes through the aperture 2 so as to be slideable therein. The relationship between the aperture and the outside wall of the pouring tube is such that a liquid tight seal is maintained therebetween for all positions of sliding movement of the pouring tube within the aperture.

With the pouring tube 7 passing through the aperture 2, a spring 10 is fitted over the pouring tube 7 so as to bias the pouring tube at one end of its full range of slideable movement within the aperture. One end of the spring 10 abuts against an abutment plate 8 which is held within the body section 1 by a retainer clip 9. Flanges situated at each end of the pouring tube 7 maintain the assembly of the body section 1 and the spring 10 within the length of the pouring tube at all times.

A hollow vent member 3 allows air to pass from the top of the body section 1 to an outlet tube 4. A vent tube 6 fits over said outlet tube 4 and is retained thereon by a coil clip 5.

Figure 2:
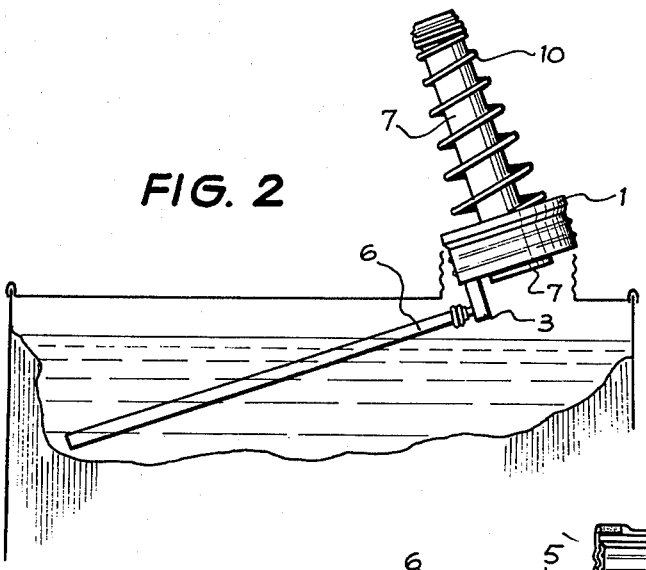
FIG. 2 is a side view of a pouring spout according to the present invention installed in a container and operative for the pouring of liquid from the container.
Figure 3:
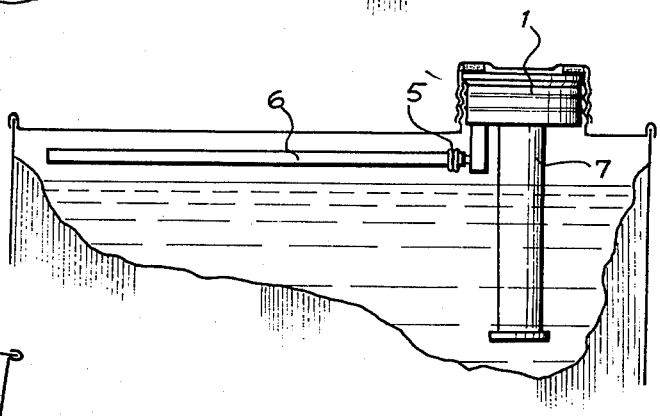
FIG. 3 is a side view of a pouring spout according to the present invention installed in a container which has been sealed with a closure means.

In operation, the body section 1 is sealingly fitted into a discharge opening in a container such as a petrol drum, oil can etc. As shown in FIG. 2, the pouring tube 7 is normally biassed outwardly from the discharge opening to a fully extended position by spring 10. When a closure means is placed over the discharge opening, the pouring tube 7 is forced into a fully retracted position against the tension of spring 10 so that it extends inwardly of the discharge opening. As can be seen from FIG. 3, the closure means provides a seal over the discharge opening so that the entire pouring spout assembly is sealed within the container.

Figure 4:
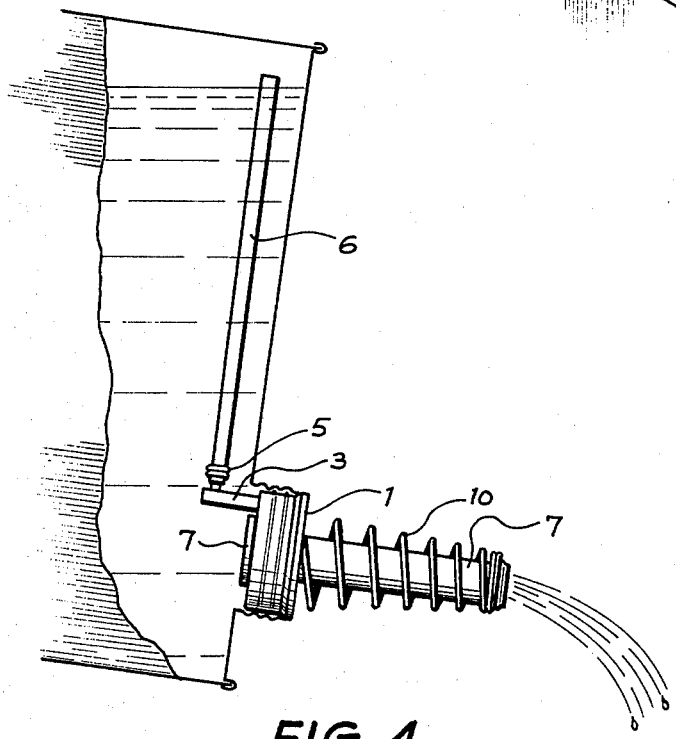
FIG. 4 is a side view of a pouring spout according to the present invention installed in a container which is shown in a tilted position so that liquid pours therefrom through the pouring spout.

When the closure means is removed from the discharge opening and the pouring tube 7 is permitted to slide outwardly under the tension of spring 10 to its fully extended position, the container may then be tilted as shown in FIG. 4 so as to allow liquid to flow through the pouring tube 7 and out of the container. At the same time, air is permitted to flow into the vent member 3 situated in the body section 1 and through the vent tube 6 into the interior of the container. The vent tube 6 is preferably directed well away from the discharge opening so that the exposed end of the vent tube is at all times maintained above the level of the liquid in the container. This means that, for all angles at which the container may be tilted, air is allowed to flow from the vent tube into the free space above the liquid level within the container so as to ensure the free flow of liquid through the pouring tube.

The body section 1, the pouring tube 7 and the vent tube 6 are preferably made from a plastics material but may alternatively be made from any material which could be considered suitable for the purpose. At least one of the flanges situated at each end of the pouring tube 7 is preferably formed after the spring 10 has been placed over the pouring tube; that is, when the body section 1, the pouring tube 7, the abutment plate 8, the retainer clip 9 and the spring 10 have all been brought together to form one complete assembly.

The body section 1 is preferably adapted to push it into a discharge opening in a container so as to form a sealing engagement therewith. For this reason, the body section 1 is preferably fabricated from a resilient material. Alternatively, the body section 1 may be adapted to screw-fit into a discharge opening, in which case provision must be made to ensure that the vent tube 6 does not foul with the inside wall of the container during rotation of the body member. Obviously, fabrication from a resilient material is not essential in the case of a screw-fit body member.

The foregoing is a description of only one preferred embodiment of the present invention and variations therein, while remaining within the area of obviousness to one skilled in the art, are still considered to be within the scope of the general concept of the invention herein described.

I claim:

1. A pouring spout for pouring liquid from an enclosed container having a discharge opening therein, said spout comprising: a body section including a bottom wall, a sidewall and an open top, said body section sealingly locatable within said discharge opening and having an aperture of lesser diameter than said body section extending through said bottom wall for providing an opening into the container when said body section is sealingly located within said discharge opening; an upstanding annular flange integral with said body and surrounding said aperture and defining with the sidewall of the body section a trough, a pouring tube passing through said aperture in said body section so that, when said body section is sealingly located within said discharge opening, said pouring tube is movable through said aperture in said body section from a fully retracted position wherein said pouring tube is located mainly within the container to a fully extended position wherein said pouring tube is located mainly outside the container, the arrangement being such that a liquid tight seal is maintained around said aperture in said body section for all positions of movement of said pouring tube between said fully retracted position and said fully extended position; vent means passing through said body section and communicating with said trough so as to allow air to pass from the outside to the inside of the container when said body section is sealingly located within said discharge opening; said vent means comprising an opening in the bottom of said trough, a hollow vent member communicating with said opening and depending from the bottom of said trough, an outlet tube connected to said hollow vent member, a vent tube fitted over said outlet tube, said vent member, outlet tube and said vent tube being disposed wholly within said container when said pouring spout is assembled therewith, said trough receiving any liquid trapped in said vent means which would normally spill when said container is tilted for a pouring operation, closure means for forming a liquid tight seal across said discharge opening when said pouring tube is in said fully retracted position and the container is not required for a pouring operation so that, in operation, said closure means is removed from said discharge opening and said pouring tube is moved from said fully retracted position to said fully extended position whereupon the container may be tilted to allow liquid to pass therefrom through said pouring tube under the pressure of air entering the container through said vent means, said pouring spout being readily removable from one container and used for connection to another container.

2. A pouring spout as claimed in claim 1, further comprising resilient means to normally bias said pouring tube to said fully extended position so that said pouring tube is moved against the force of said resilient means into said fully retracted position when said closure means is sealingly engaged with said discharge opening.

3. A pouring spout as claimed in claim 2, wherein said resilient means is a compression spring acting between said body section and a flange formed at one end of said pouring tube.

4. A pouring spout as claimed in claim 1, wherein said tube is directed substantially away from said discharge opening so that the exposed end of said tube is maintained substantially above the level of liquid in the container for all tilting angles thereof while pouring.

5. A pouring spout as claimed in claim 1, wherein said body section is adapted to a push-fit into said discharge opening.

* * * * *